US006558296B2

(12) United States Patent
Herb, Jr.

(10) Patent No.: US 6,558,296 B2
(45) Date of Patent: May 6, 2003

(54) STATIONARY EXERCISE APPARATUS

(76) Inventor: Cuthbert Leonard Herb, Jr., 11733 Kiowa Ave., #3, Los Angeles, CA (US) 90049

( * ) Notice: Subject to any disclaimer, the term of this patent is extended or adjusted under 35 U.S.C. 154(b) by 27 days.

(21) Appl. No.: 09/843,081

(22) Filed: Apr. 25, 2001

(65) Prior Publication Data

US 2002/0032105 A1 Mar. 14, 2002

Related U.S. Application Data

(60) Provisional application No. 60/200,498, filed on Apr. 25, 2000.

(51) Int. Cl.[7] ..... A63B 21/00
(52) U.S. Cl. ..... 482/57; 482/62
(58) Field of Search ..... 482/51, 57, 61–65, 482/148

(56) References Cited

U.S. PATENT DOCUMENTS 5,584,783 A 12/1996 Hagg

*Primary Examiner*—Glenn E. Richman
(74) *Attorney, Agent, or Firm*—Kleinberg & Lerner, LLP

(57) ABSTRACT

An exercise bicycle includes a bottom frame, a fork and front support coupled to the bottom frame and extending upward, handlebars moveably coupled to a top of the fork, a flywheel rotationally coupled to the fork, a rear support coupled to the bottom frame extending upward and supporting a seat. The seat and flywheel define a longitudinal axis, the bottom frame is oriented substantially parallel thereto, a support bar being coupled to the bottom frame and the rear support, a stack of resistance plates coupled to the top of the front support, additional stacks of plates coupled near the bottom of the front support, near the second end of the bottom support and coupled to the support bar, wherein each stack of plates consists of individual resistance plates oriented transverse to the longitudinal axis.

15 Claims, 6 Drawing Sheets

FIG. 3
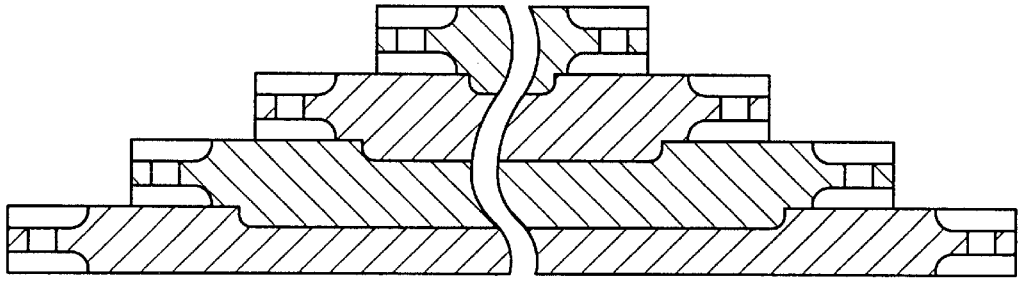
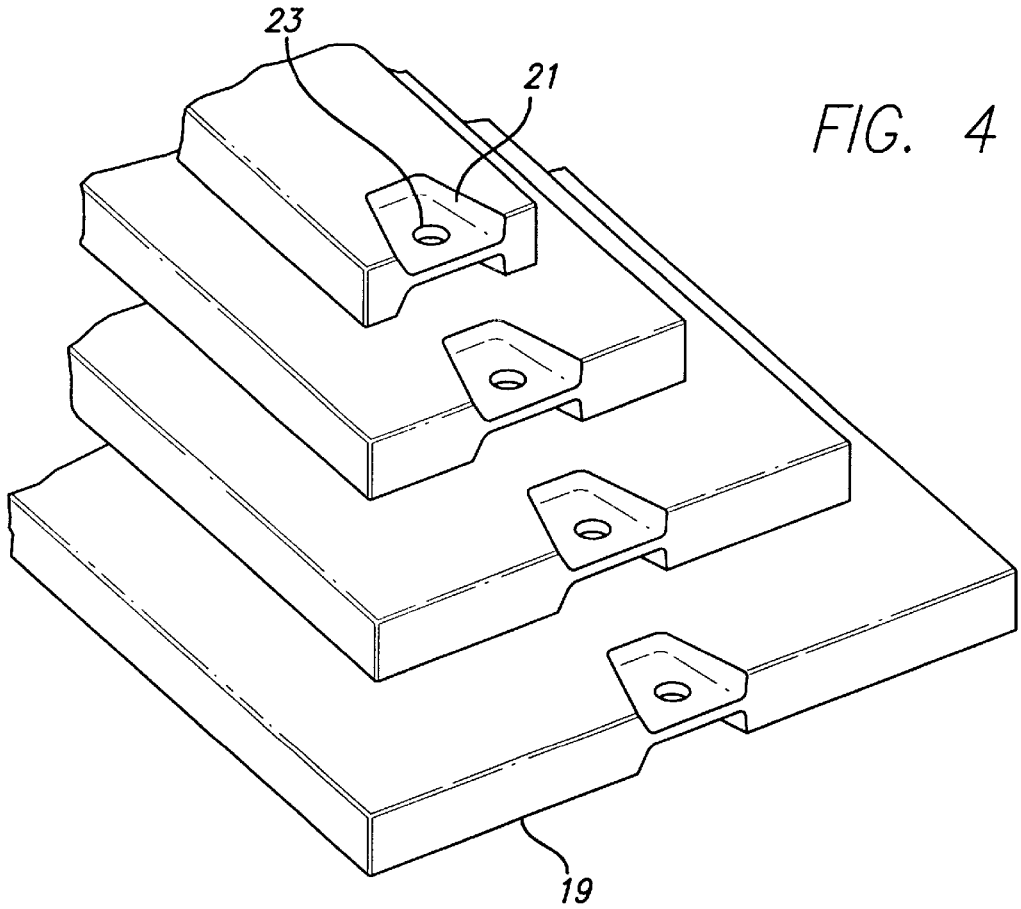
FIG. 4

FIG. 5
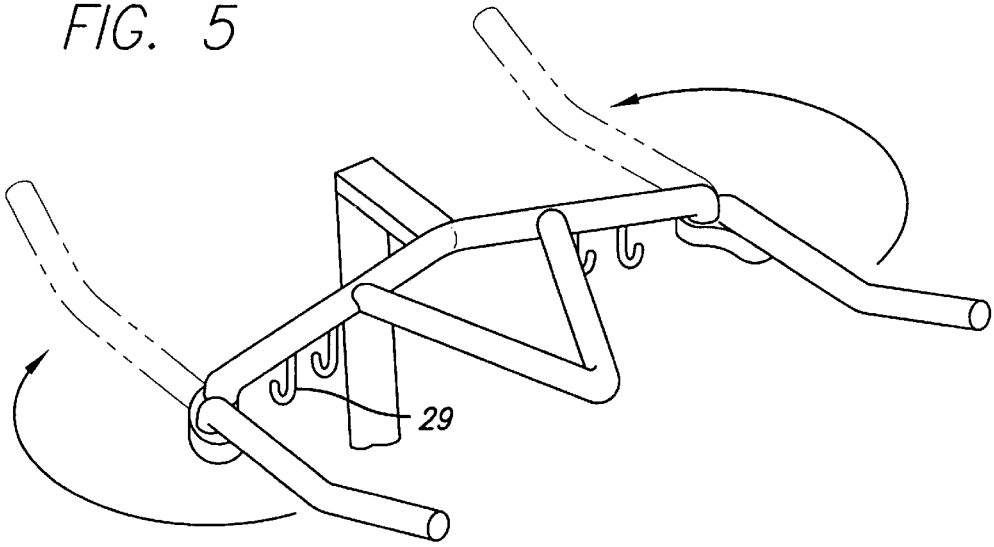
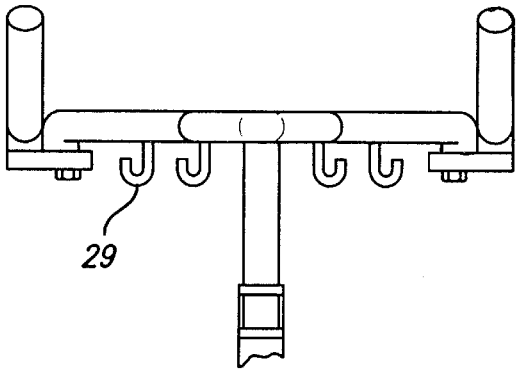
FIG. 6
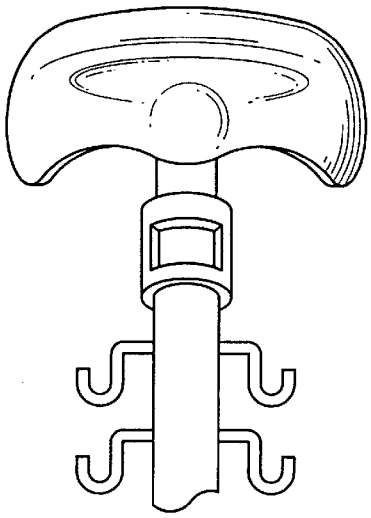
FIG. 7

STATIONARY EXERCISE APPARATUS

CROSS-REFERENCE TO RELATED APPLICATIONS

This application is a continuation in part of United States provisional patent application serial No. 60/200,498 filed on Apr. 25, 2000.

FIELD OF THE INVENTION

The present invention relates to the field of exercise equipment and, more specifically to an exercise apparatus that can provide means for upper body exercise concurrently with bicycling exercise.

BACKGROUND OF THE INVENTION

It is well known in the prior art that a stationary bicycle provides a beneficial form of low impact, cardiovascular exercise. Such an exercise apparatus can also provide strength training for the legs and for other portions of the lower body. While certain benefits arise from the use of an exercise bicycle, such a device fails to provide a means for anaerobic or upper body exercise. Thus, the use of an exercise bicycle alone is helpful but fails to provide an overall fitness regimen that provides both cardiovascular and anaerobic/strength training. An invention that concurrently provides both benefits would clearly be beneficial.

Prior art has relied upon different types of exercise machines to provide upper-body exercise. In many instances, these devices are inappropriate and/or cumbersome for today's user. For example, a multiple machine approach to cardiovascular and strength training uses unnecessary space. This is normally a particularly important issue for home exercise equipment because the typical home has a very limited space available for an exercise area. The multiple device approach also increases exercise time because it requires the user to shift from one machine to the next after each workout set. Down time while shifting to another machine negatively impacts the usefulness of the of exercise by allowing a rest period between sets of exercises. The multiple machine approach to a home gymnasium also increases equipment cost to the user by requiring the user to purchase multiple machines. For all of these reasons, a need has arisen for a space saving and cost efficient multiple use exercise machine for the home gymnasium.

The present invention overcomes the prior art limitations by providing a single exercise apparatus that allows concurrent cardiovascular exercise, in the form of an exercise bicycle apparatus, and upper body strength training through resistance devices connected to the frame of the apparatus. The present invention results in exercise apparatus that is less costly, more efficient and more compact. It therefore provides a clear improvement over existing technology in this area of exercise equipment.

SUMMARY OF THE INVENTION

The present invention is an exercise apparatus designed to concurrently allow both cardiovascular and anaerobic exercise. More specifically, the present invention combines an exercise bike with resistant devices that attach to the invention in such a manner as to additionally allow for anaerobic exercise. Concurrently, the resistance devices allow for the exercise of the muscles of the upper portions of the body in much the same manner, as one would receive from more traditional training using weights. By combining cardiovascular and anaerobic exercises, the user achieves a much more efficient work out.

The present invention achieves these results by integrating an exercise bicycle with a frame that is capable of receiving resistance devices, as is further discussed below. The resistance devices operate on the same principle as weights in that each such device provides resistance to efforts by the muscles of the body to move the devices. However, for numerous reasons, the resistance devices are much more efficient than weights.

The resistance devices of the present invention are flexible plates of varying lengths. The various lengths of plates offer varying degrees of flexibility. Varying combinations of plates, stacked upon each other, offer an even greater range of flexibility. The plate(s) are removably affixed at various locations on the frame of the exercise apparatus so as to allow for the efficient exercise of various parts of the upper body. Each plate has means at each of two opposing ends for the connection of a cable.

One end of the cable is attached to the connecting plate and the other end of the cable is either attached to a handle or looped to form a handle. The cable is affixed to the frame of the exercise apparatus through guide loops so that a user can reach the cable handles while positioned on the seat of the exercise apparatus. By pulling on the cables, the user encounters resistance from the flexible plate. The resistance exercises the muscles being used to pull the cables.

The exercise apparatus of the present invention is designed such that flexible plates can be attached to multiple locations on the apparatus. Multiple cables can therefore be simultaneously attached to the exercise apparatus. Hooks are placed at various locations on the frame of the exercise apparatus in order to position the cables so that they are out of the way when not in use. Guide loops are placed at various locations on the apparatus to prevent the cables from interfering with exercising on the apparatus.

BRIEF DESCRIPTION OF THE DRAWINGS

FIG. 3 is a detailed view showing the flexible plates of the present invention.

FIG. 4 is an additional detailed view showing the flexible plates of the present invention.

FIG. 5 is a detailed view showing the handlebars of the exercise apparatus of the present invention.

FIG. 6 is a detailed view showing how the handlebars of the exercise apparatus of the present invention can be adjusted.

FIG. 7 is a detailed view showing the seat of the exercise apparatus of the present invention.

DETAILED DESCRIPTION OF THE INVENTION

An exercise apparatus will be described. In the description, for purposes of explanation, specific construction details, arrangements and materials may be set forth in order to provide a more thorough understanding of the present invention. In some instances, it will be apparent to those skilled in the art that the present invention may be practiced without these specific details. In other instances, well known manufacturing methods and structures have not been described in detail, so as to avoid unnecessarily obscuring the present invention.

Figure 1:
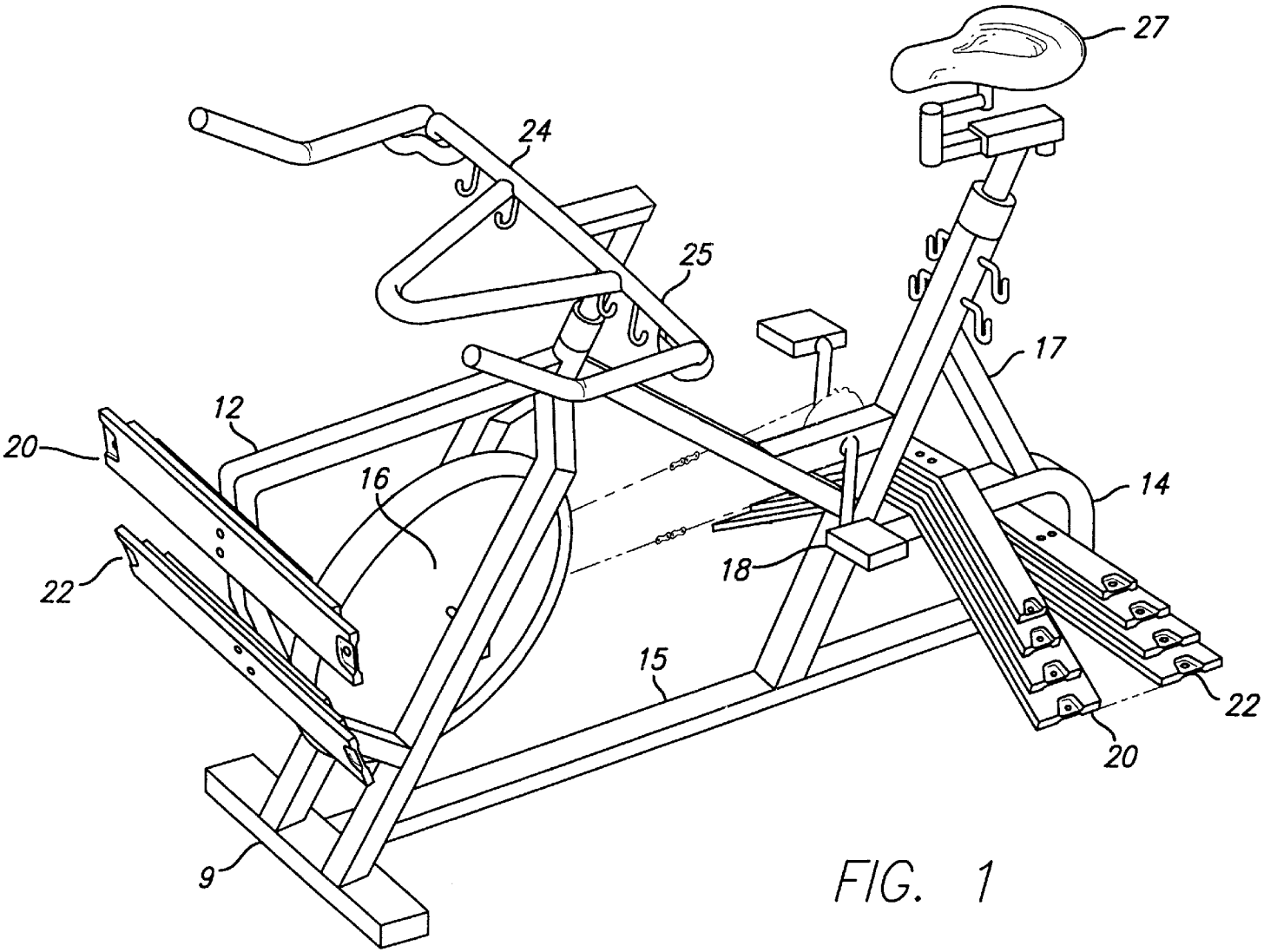
FIG. 1 is a perspective view of the exercise apparatus of the present invention.

Referring first to FIG. 1, a perspective view of the exercise apparatus 8 of the present invention is shown. The invention includes an exercise bicycle 10 comprising a frame 11 for cycling means 10 and including two base points (front 9 and back 14).

The frame consists of a bottom frame member 15 having first and second ends, a fork member 31 coupled to the first end of the bottom frame member 15, and extending generally upward, handlebars 24 moveably coupled to a top end of the fork member 31, a flywheel 16 rotationally coupled to the fork member 31, a rear support member 14 coupled to the bottom frame member, near the second end of the bottom frame member, and extending generally upward therefrom supporting a seat.

The front base bar 12 is a substantially vertical frame member connected, at the top, to the bicycle frame 11 between the handlebars 24 and the fork 31 of the forward vertical member of frame 11. The front bar 12 continues, angled far enough forward and downward, to avoid contact with the flywheel 16. At a point that allows for clearance from the flywheel 16, the bar 12 bends downward and inward, towards the bottom of the fork 31 holding the flywheel 16. The first set of plates 20 is affixed to the frame 11 at this point. The front bar 12 next bends further inward and a second set of plates 22 is attached at this location. In the preferred embodiment, both the first set of plates 20 and the second set of plates 22 rotate to a vertical position in order to conserve space. The front bar 12 then bends further inward and connects to the fork 31.

A third set of plates 30 is attached near the rear portion of the frame 11 and beneath seat 27. This set of plates 30 is angled, as is shown in FIG. 1, to provide greater Range of Motion capability.

The second bar 14 is in the form of a "J" and attaches at one end to the vertical portion 17 of the frame 11 connecting the seat 27 and the floor bar 15 of the frame. A fourth set of plates 32 is attached to the frame at the rear of the floor bar 15.

Figure 2:
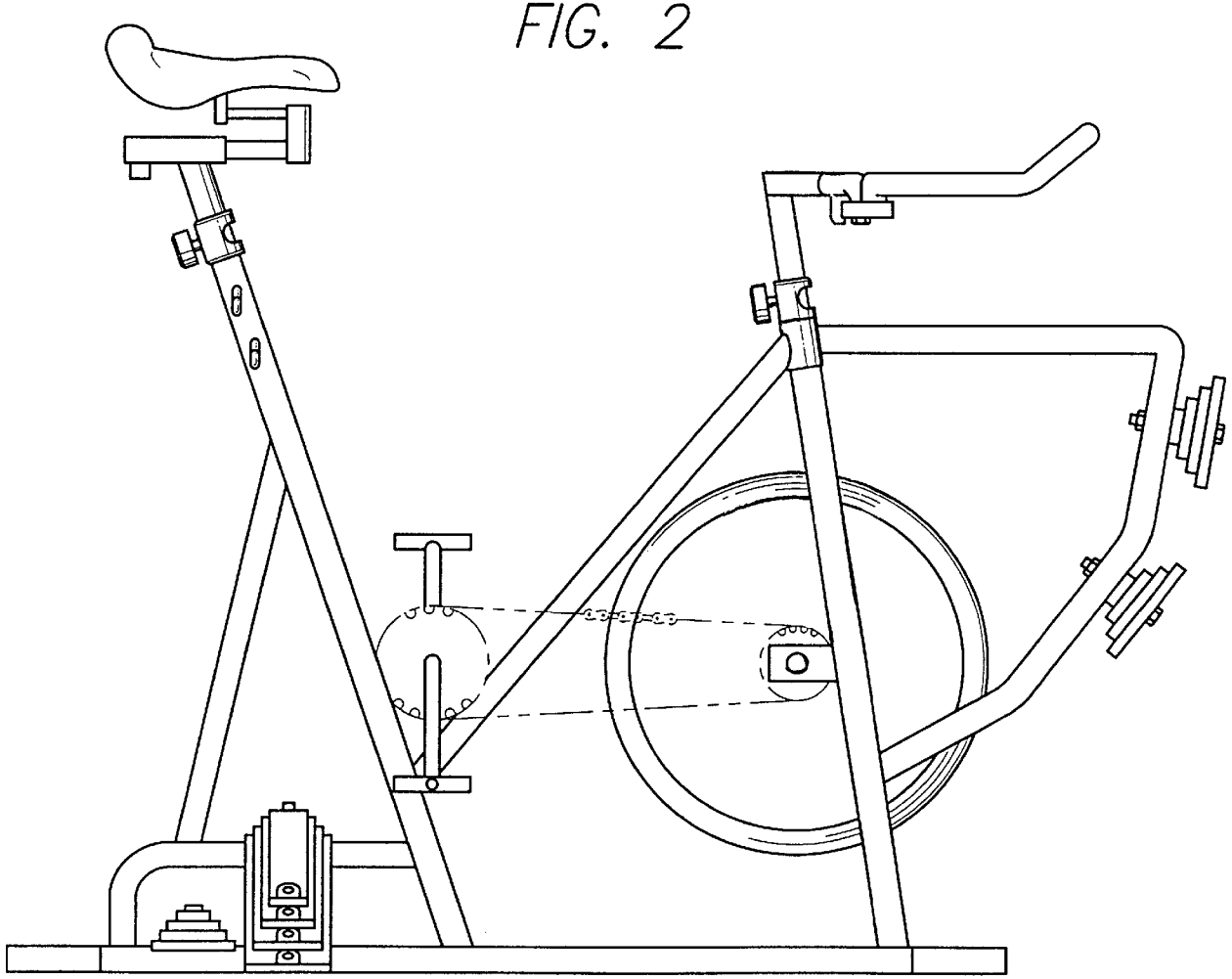
FIG. 2 is a side view of the exercise apparatus of the present invention.

The frame 11 contains a flywheel 16 connected to a pedal mechanism 18 via a bicycle chain. FIG. 2 presents a side view of the exercise apparatus 8 of the present invention. Attached to the handle bar mechanism 24 and to the vertical portion of the bicycle 10 below the seat, are hooks 25 that serve as holders for cables 26.

FIGS. 3 and 4 present a set of flexible plates. In the preferred embodiment, the sets of plates form the resistance devices for the exercise apparatus 8. Also in the preferred embodiment, sets of plates (20, 22, 30, 32) are attached at various locations on the exercise apparatus 8 as shown in FIGS. 1 and 2. The location of the plates 20 as they are affixed to the frame 11 is such that a user is able to exercise various locations of the upper body through the use of various cables 26 attached to said plates 19 at their said various locations (20, 22, 30, 32). By way of a very simple example, the plates 20 in the forward position of the exercise bicycle frame 11 allow the user to exercise the biceps and triceps. The plates 30 in the rear position of the frame 11 allow the user to perform military presses and other exercises and thereby exercise the shoulder and back muscles.

The use of sets of plates 19 allows for varying degrees of resistance without requiring the weight or space used by more traditional free weights. Resistance levels are increased or decreased by varying both the number and size of plates 19 in a stack.

FIGS. 3 and 4 present a more detailed view of the flexible plates 19 of the present invention. A flexible plate 19 provides a reasonably controlled resistance to bending and stacks of flexible plates 19 provide additional resistance. Different sizes of plates 19 are used to provide varying degrees of resistance, as shown in FIG. 4. The ends of a flexible plate 19 connect to a cable 26 (best illustrated in FIG. 8). The other end of the cable 26 is connected to a handle 28. The cable 26 can connect to one or more flexible plates 19 to provide varying resistance levels. The user pulls the cable 26 to provide anaerobic exercise for the muscles of the upper body.

FIGS. 3 and 4 provide details on the design of the plates 19 in their preferred embodiment. The plates are rectangular in shape. The cables 26 attach to a plate at each of two opposing and lengthwise ends. Each such end has a "u" shaped indentation 21 on both the top and the bottom surfaces of the plate. Each such indentation 21 has a hole 23 that passes through the plate. In the preferred embodiment, the cable 26 has hooks 29 at one end that passes through the hole 23 and thereby couples the cable 26 to the plate 19. Although the preferred embodiment shows plates 19 at four locations (20, 22, 30, 32) on the frame 11, other locations may be acceptable to vary the exercise goals of the apparatus.

FIGS. 5 and 6 illustrate the handle bar apparatus 24 of the invention. The handle bar 24 contains rest hooks 25 to support cable handles 28 attached to cables 26. The loops 25 allow the cables 26 to be placed out of the way of the user when the cables 26 are not being used. The bicycle handle bar 24 is pivotal on a horizontal plane so that it can be rotated towards the user to offer greater support when the user is exercising the upper body.

Guide loops 34 are placed along the front vertical bar of the frame and along the handlebar 24 to allow for a more bio-mechanically correct exercise. In the preferred embodiment, three such guide loops 34 are placed on each side of the longitudinal axis, on the forward vertical frame member of the frame 11.

FIGS. 5, 6 and 7 show the handle bar 24 of the current invention 8. Each of the two bars comprising the handle bar 24 is capable of pivoting on the remainder of the bar, in a horizontal plane. In the forward position pointing to the front of the apparatus, the bars 24 provide arm rests while bicycling. In the backward position towards the rear of the apparatus, the bars 24 provide support during upper body exercises.

Figure 8:
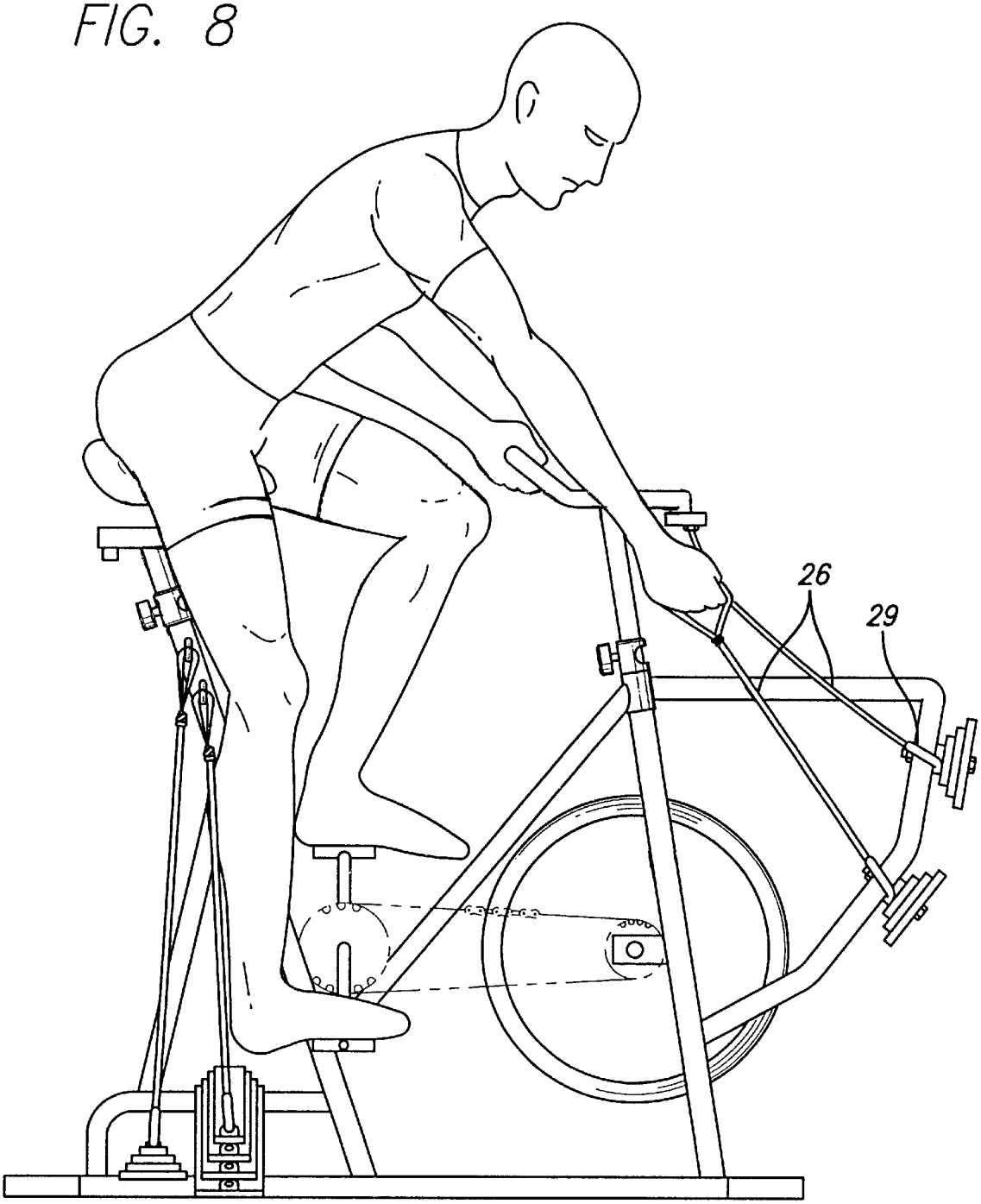
FIG. 8 illustrates the use of the exercise apparatus of the present invention for upper body exercises.

FIG. 8 illustrates the exercise apparatus 8 in use with the user using the exercise bicycle 10 for cardiovascular exercise. Concurrently with cardiovascular exercise, the user is pulling on handles/loops 28 attached via cables 26 to resistance devices in the form of flexible plates 19 in order to provide anaerobic exercise for the upper portions of the body. Other cables 26 located at the rear of the exercise apparatus 8 are attached to plates 19 at one end and to hooks 25 at the other end of the cable 26.

Figure 9:
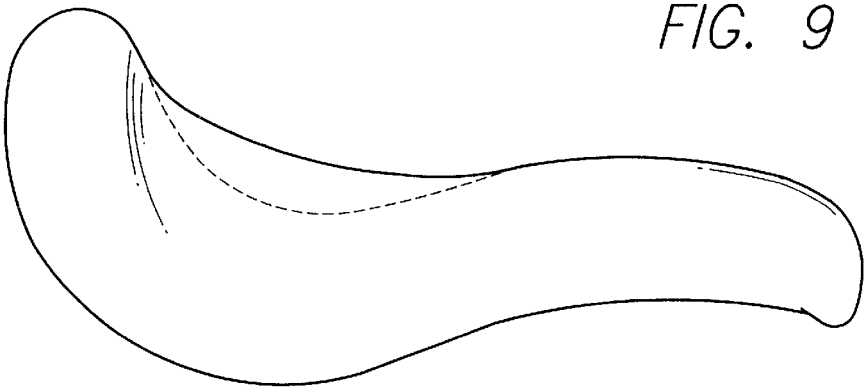
FIG. 9 is a detailed view showing the seat of the exercise apparatus of the present invention.
Figure 10:
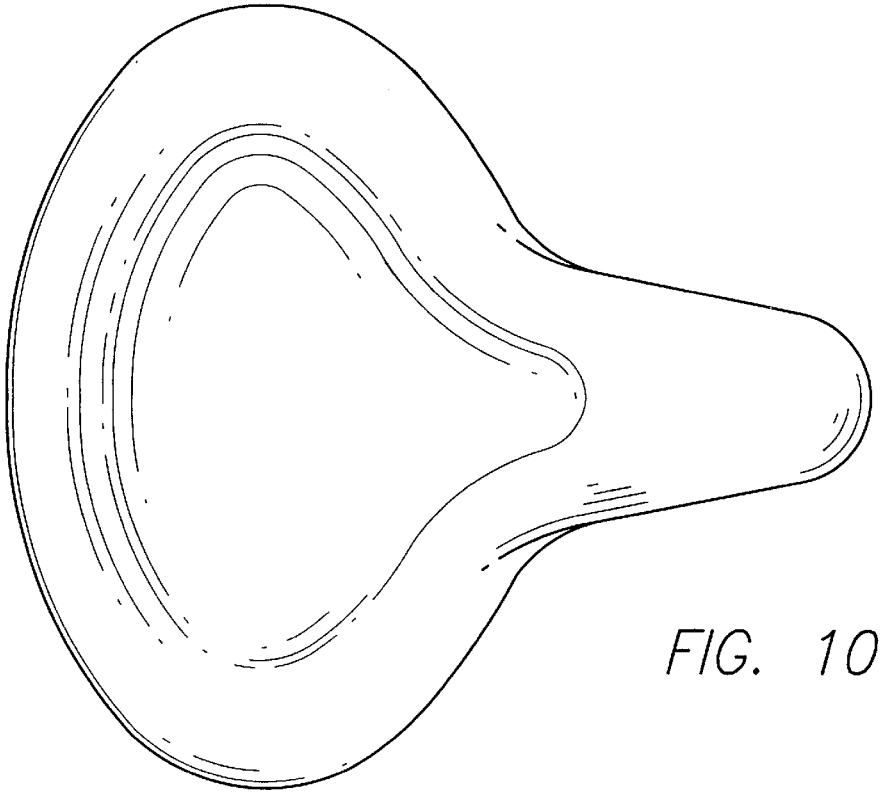
FIG. 10 is a detailed view showing the seat of the exercise apparatus of the present invention.

FIGS. 9 and 10 illustrate the bicycle seat 27 of the exercise bicycle 10. Said seat 27 is wider than a typical bicycle support, to provide better support to the spine while exercising.

It should be noted that the description of the present invention has been made with respect to specific arrangements and constructions of the preferred embodiment of the present invention. It will be apparent to those skilled in the art of exercise equipment that the foregoing descriptions are illustrative only and that various changes and modifications can be made to the present invention without departing from the overall spirit and scope of the present invention.

What is claimed is:

1. A stationary exercise apparatus, comprising:

a stationary bicycle mounted on a frame, said frame including a base member oriented substantially horizontally, and a front member oriented substantially vertically;

at least a first stack of flexible plates coupled to said base member;

at least a second stack of flexible plates coupled to said front member;

wherein each of said flexible plates has a first end and a second end and includes attachment means disposed at each of said ends of said plate;

at least one cable having a first end and a second end, and including a handle coupled to said first end, and a hook means coupled to said second end, said hook means engaging with said attachment means.

2. The device of claim 1, wherein said stacks of flexible plates include a plurality of plates having differing lengths, widths and thickness stacked on top of each other.

3. The device of claim 2 wherein said length, width and thickness of each plate is smaller than the corresponding dimensions of the plate immediately beneath it in said stack.

4. The device of claim 2 wherein said plates are manufactured from fiber-impregnated plastic.

5. The device of claim 1 further comprising retention hooks located on said frame, said retention hooks adapted to hold said handle of said at least one cable.

6. The device of claim 1 further comprising guide loops located on said frame and adapted to direct said at least one cable away from said stationary bicycle and said frame when said exercise apparatus is in use.

7. A stationary exercise apparatus, comprising:

a frame supporting a seat and a flywheel, said flywheel being rotationally coupled to said frame;

wherein said seat and said flywheel define a longitudinal axis of said stationary exercise apparatus;

at least one stack of resistance plates coupled to said front support member near said top end of said front support member, said at least one stack of resistance plates being comprised of a plurality of individual resistance plates disposed on top of each other, and said at least one stack of resistance plates is oriented transverse to said longitudinal axis.

8. The device of claim 7 further comprising at least one cable, said cable having a first end and a second end, a handle coupled to a said first end of said cable, and an attachment hook coupled to said second end of said cable.

9. The device of claim 7 wherein said resistance plates are substantially rectangular in shape.

10. The device of claim 8 further comprising cable guide loops coupled to said frame.

11. The device of claim 8 further comprising resting hooks coupled to said frame, said resting hooks adapted to hold said handle of said at least one cable.

12. A stationary exercise apparatus, comprising:

a bottom frame member, said bottom frame member having first and second ends;

a fork member coupled to said first end of said bottom frame member, and extending generally upward therefrom;

handlebars moveably coupled to a top end of said fork member;

a flywheel rotationally coupled to said fork member;

a rear support member coupled to said bottom frame member near said second end of said bottom frame member, and extending generally upward therefrom, said support member supporting a seat;

a pedal and chain assembly coupled to said rear support member and said flywheel;

wherein said seat and said flywheel define a longitudinal axis of said stationary exercise apparatus, and wherein said bottom frame member is oriented substantially parallel to said longitudinal axis;

a front support member coupled to said fork and oriented substantially vertically, said front support member having a top and a bottom end;

a support bar coupled to said second end of said bottom frame member and said rear support member;

a first stack of resistance plates coupled to said front support member near said top end of said front support member;

a second stack of resistance plates coupled near said bottom end of said front support member;

a third stack of resistance plates coupled near said second end of said bottom support member;

a fourth stack of resistance plates coupled to said support bar;

wherein each of said stacks of said resistance plates is comprised of a plurality of individual resistance plates disposed on top of each other, and said stacks of resistance plates are each oriented transverse to said longitudinal axis.

13. The device of claim 12 wherein said first and second stacks of resistance plates are coupled to said front support member by a hinge means.

14. The device of claim 11 further comprising guide loops and resting hooks coupled to said frame.

15. The device of claim 14 wherein said resistance plates are manufactured from fiber-impregnated plastic.

* * * * *